US006935432B2

(12) United States Patent
Nguyen

(10) Patent No.: US 6,935,432 B2
(45) Date of Patent: Aug. 30, 2005

(54) METHOD AND APPARATUS FOR FORMING AN ANNULAR BARRIER IN A WELLBORE

(75) Inventor: Philip D. Nguyen, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/251,357

(22) Filed: Sep. 20, 2002

(65) Prior Publication Data

US 2004/0055760 A1 Mar. 25, 2004

(51) Int. Cl.[7] ..... E21B 33/12

(52) U.S. Cl. ..... 166/387; 166/135

(58) Field of Search ..... 166/387, 57, 207, 166/179, 135, 195, 192, 376

(56) References Cited

U.S. PATENT DOCUMENTS

| | | | | |
|---|---|---|---|---|
| 2,214,226 A | | 9/1940 | English | 166/1 |
| 2,646,845 A | | 7/1953 | Schillinger | 166/13 |
| 2,738,017 A | | 3/1956 | Lynes | 166/196 |
| 3,097,696 A | | 7/1963 | Orr | 166/135 |
| 3,099,318 A | | 7/1963 | Miller et al. | |
| 3,203,451 A | | 8/1965 | Vincent | 138/143 |
| 3,235,017 A | | 2/1966 | Lynes | 175/321 |
| 3,385,367 A | | 5/1968 | Kollsman | |
| 3,477,506 A | | 11/1969 | Malone | 166/207 |
| 3,784,214 A | | 1/1974 | Tamplen | 277/116.8 |
| 3,842,912 A | * | 10/1974 | Lindsey, Jr. | 166/307 |
| 4,137,970 A | | 2/1979 | Laflin et al. | 166/292 |
| 4,484,626 A | | 11/1984 | Kerfoot et al. | 166/191 |
| 4,498,536 A | | 2/1985 | Ross et al. | |
| 4,528,104 A | * | 7/1985 | House et al. | 507/233 |
| 4,629,991 A | | 12/1986 | Wheeler | |
| 4,715,442 A | | 12/1987 | Kahil et al. | |
| 4,936,386 A | * | 6/1990 | Colangelo | 166/292 |
| 5,083,608 A | | 1/1992 | Abdrakhmanov et al. | 166/55 |
| 5,337,823 A | | 8/1994 | Nobileau | 166/277 |
| 5,366,012 A | | 11/1994 | Lohbeck | 166/277 |
| 5,664,628 A | | 9/1997 | Koehler et al. | 166/369 |

(Continued)

FOREIGN PATENT DOCUMENTS

| | | |
|---|---|---|
| EP | 1223305 A2 | 7/2002 |
| GB | 2366581 A | 3/2002 |
| GB | 2370301 A | 6/2002 |

(Continued)

OTHER PUBLICATIONS

Halliburton, "ANJEL®," *Conformance Technology Manual*, Chapter 4, Aug. 1995, pp. 4–34, 4–35.

(Continued)

*Primary Examiner*—David Bagnell
*Assistant Examiner*—Daniel P Stephenson
(74) *Attorney, Agent, or Firm*—Albert C. Metrailer

(57) ABSTRACT

In accordance with the present invention, an apparatus and method are provided which utilize an expandable media assembly to create an annular barrier in a subterranean well. The apparatus comprises a tubing assembly for placement in the wellbore, the tubing assembly having an outer surface creating an annular space with the wellbore when the tubing assembly is placed in the wellbore. The apparatus has an expandable media assembly having an expandable material. The expandable material is initially in a run-in position and is capable of increasing in volume to a set position in the wellbore thereby creating an annular barrier blocking fluid flow along the annular space. The expandable material can be a foam, gel, or alloy. The media can be deformable upon enlargement and conform to the wellbore wall. The media can be a sleeve secured to the tubular assembly or a medium carried in a pressurized canister for release at a selected location downhole. The expandable material can be held in the run-in position by a restraint, if necessary. The media can be thermally, chemically or otherwise activated to expand and can be used in conjunction with radially expandable screen assemblies and tubing assemblies.

15 Claims, 3 Drawing Sheets

U.S. PATENT DOCUMENTS 5,709,269 A * 1/1998 Head ..... 166/376
5,718,288 A 2/1998 Bertet et al. ..... 166/287
5,833,001 A 11/1998 Song et al. ..... 166/287
5,875,845 A 3/1999 Chatterji et al. ..... 166/293
5,901,789 A 5/1999 Donnelly et al. ..... 166/381
5,964,288 A 10/1999 Leighton et al. ..... 166/207
6,012,522 A 1/2000 Donnelly et al. ..... 166/276
6,044,906 A 4/2000 Saltel ..... 166/187
6,135,208 A 10/2000 Gano et al. ..... 166/313
6,150,601 A 11/2000 Schnatzmeyer et al.
6,173,788 B1 1/2001 Lembcke et al. ..... 166/387
6,263,972 B1 7/2001 Richard et al.
6,302,214 B1 * 10/2001 Carmichael et al. ..... 166/373
6,328,113 B1 12/2001 Cook ..... 166/387
6,333,700 B1 12/2001 Thomeer et al.
6,412,565 B1 7/2002 Castano-Mears
6,415,509 B1 7/2002 Echols et al.
6,415,869 B1 7/2002 Smith
6,431,282 B1 8/2002 Bosma et al. ..... 166/288
6,446,717 B1 * 9/2002 White et al. ..... 166/187
6,450,261 B1 9/2002 Baugh ..... 166/277
6,457,518 B1 10/2002 Castano-Mears et al. ... 166/207
6,457,533 B1 10/2002 Metcalfe ..... 166/381
6,530,574 B1 3/2003 Bailey et al. ..... 277/314
6,543,545 B1 4/2003 Chatterji et al.
6,581,682 B1 6/2003 Parent et al. ..... 166/180
6,634,431 B2 10/2003 Cook et al. ..... 166/387
6,695,067 B2 2/2004 Johnson et al. ..... 166/387
6,722,433 B2 4/2004 Brothers et al. ..... 166/288
2001/0045289 A1 11/2001 Cook et al.
2001/0047866 A1 12/2001 Cook et al.
2001/0047870 A1 12/2001 Cook et al.
2001/0054969 A1 12/2001 Thomeer et al.
2002/0020524 A1 2/2002 Gano
2002/0040787 A1 4/2002 Cook et al.
2002/0046840 A1 4/2002 Schetky et al.
2002/0050360 A1 5/2002 Cook et al.
2002/0060068 A1 5/2002 Cook et al.
2002/0060069 A1 5/2002 Cook et al.
2002/0060078 A1 5/2002 Cook et al.
2002/0074130 A1 6/2002 Cook et al.
2002/0074134 A1 6/2002 Cook et al.
2002/0084078 A1 7/2002 Cook et al.
2002/0088744 A1 7/2002 Echols et al.
2002/0092648 A1 7/2002 Johnson et al.
2002/0092649 A1 7/2002 Bixenman et al.
2002/0092654 A1 7/2002 Coronado et al. ..... 166/369
2002/0092657 A1 7/2002 Cook et al.
2002/0092658 A1 7/2002 Johnson et al.
2002/0096329 A1 7/2002 Coon et al. ..... 166/278
2002/0108756 A1 8/2002 Harrall et al. ..... 166/382
2002/0121372 A1 9/2002 Cook et al. ..... 166/250.07
2002/0125009 A1 9/2002 Wetzel et al. ..... 166/278
2002/0129939 A1 9/2002 Genolet et al. ..... 166/285
2002/0139540 A1 10/2002 Lauritzen ..... 166/387
2002/0148612 A1 10/2002 Cook et al. ..... 166/313
2002/0166672 A1 11/2002 White et al. ..... 166/387
2003/0234102 A1 12/2003 Brothers et al. ..... 166/387
2004/0035588 A1 2/2004 Doane et al. ..... 166/382
2004/0035590 A1 2/2004 Richard ..... 166/384
2004/0040703 A1 3/2004 Longmore ..... 166/207
2004/0055758 A1 3/2004 Brezinski et al. ..... 166/384
2004/0055760 A1 3/2004 Nguyen ..... 166/387
2004/0112609 A1 6/2004 Whanger et al. ..... 166/380

FOREIGN PATENT DOCUMENTS

GB 2376486 A 12/2002
GB 2380752 A 4/2003
GB 2 398 087 A 8/2004
WO WO 9925951 5/1999
WO WO 9956000 11/1999
WO WO 0118353 A1 3/2001
WO WO 0192681 A1 12/2001
WO WO 0220941 A1 3/2002
WO WO 0223007 A1 3/2002
WO WO 02/059452 8/2002 ..... E21B/33/00
WO WO 02059452 A1 8/2002

OTHER PUBLICATIONS

Halliburton Energy Services, "MATROL and MATROL II Service Complexed Polymer Barrier For Use in Producing and Injection Wells," *Field Bulletin*, May 1993, pp. 1–5.
Halliburton, "ResSeal Water Shutoff Resin Kit Application Instructions," Pub. 1996, Halliburton Company.
Inorganic Gel, Trade Name: Halliburton Energy Services Angard® Service; General Overview Outline.

* cited by examiner

METHOD AND APPARATUS FOR FORMING AN ANNULAR BARRIER IN A WELLBORE

FIELD OF INVENTION

The invention relates to forming an annular barrier in a wellbore for isolating subterranean zones. More specifically, the invention relates to methods and apparatus for forming annular barriers in a subterranean wellbore through placement of an expandable, impermeable medium into the wellbore annular space to prevent fluid flow along the annular space.

BACKGROUND

This invention relates generally to oil and gas exploration, and in particular to isolating certain subterranean zones to facilitate oil and gas exploration.

During oil exploration, a wellbore typically traverses a number of zones within a subterranean formation. Some of these subterranean zones will produce oil and gas, while others will not. Further, it is often necessary to isolate subterranean zones from one another in order to facilitate the exploration for and production of oil and gas. Existing methods for isolating subterranean production zones in order to facilitate the exploration for and production of oil and gas are complex and expensive.

The present invention is directed to overcoming one or more of the limitations of the existing processes for isolating subterranean zones during oil and gas exploration and production.

SUMMARY

In accordance with the present invention, an apparatus and method are provided which utilize an expandable media assembly to create an annular barrier in a subterranean well. The apparatus comprises a tubing assembly for placement in the wellbore, the tubing assembly having an outer surface creating an annular space with the wellbore when the tubing assembly is placed in the wellbore. The apparatus has an expandable media assembly having an expandable material. The expandable material is initially in a run-in position and is capable of increasing in volume to a set position in the wellbore thereby creating an annular barrier blocking fluid flow along the annular space. The expandable material can be a foam, gel, or alloy. The media can be deformable upon enlargement and conform to the wellbore wall. The media can be a sleeve secured to the tubular assembly or a medium carried in a pressurized canister for release at a selected location downhole. The expandable material can be held in the run-in position by a restraint, if necessary. The media can be thermally, chemically or otherwise activated to expand and can be used in conjunction with radially expandable screen assemblies and tubing assemblies.

BRIEF DESCRIPTION OF THE DRAWINGS

Drawings of the preferred embodiment of the invention are attached hereto, so that the invention may be better and more fully understood.

DETAILED DESCRIPTION OF EMBODIMENTS OF THE INVENTION

Figure 1:
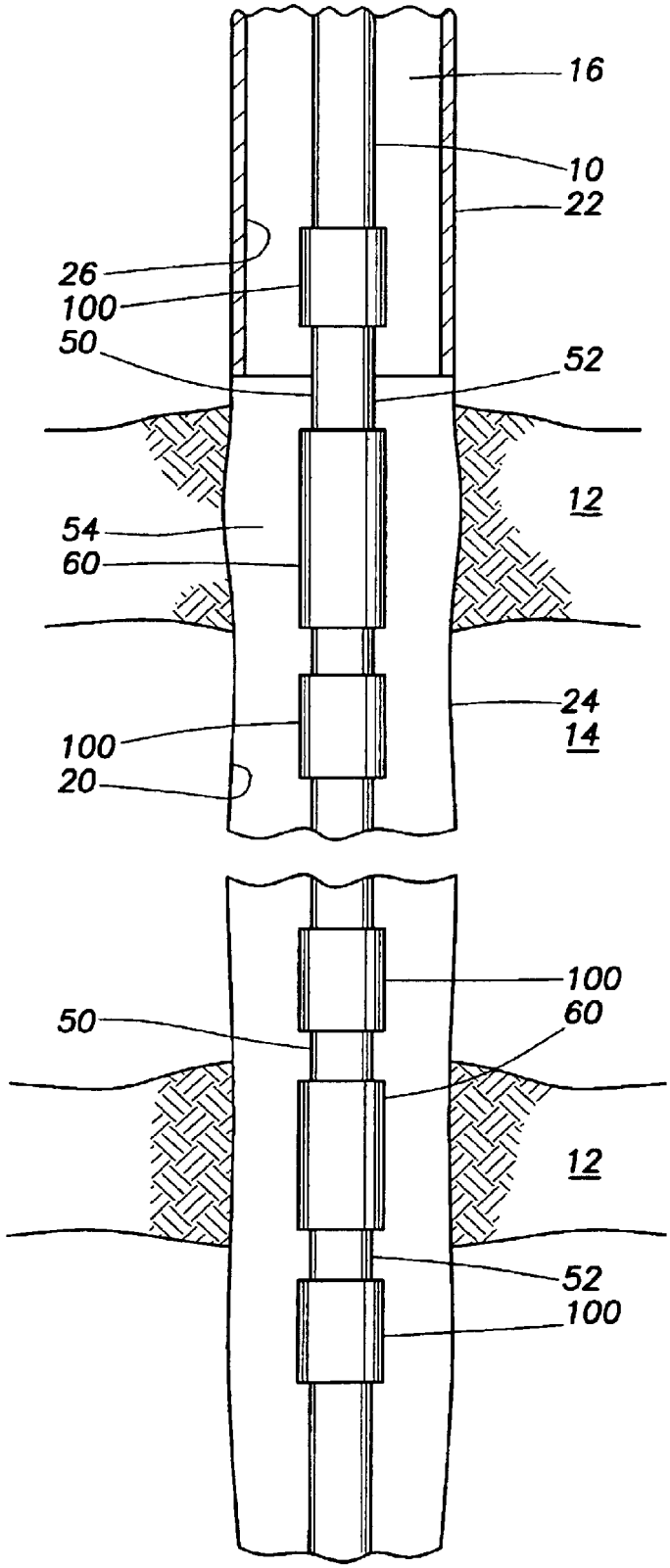
FIG. 1 is an elevational view of a multi-zoned subterranean wellbore and a tubing string with expandable media apparatus.

Referring now to FIG. 1, a tubing string 10 is shown run into well 16 at least to a zone or zones of interest 12 of the formation 14. The well 16 can be on-shore or off-shore, vertical or horizontal, or cased or open-hole wells. It is expected that the invention will be primarily utilized in open-hole wells, but it is not limited to such use. The tubing string 10 or work string extends from the well surface into the well bore 20. The well bore 20 extends from the surface into the subterranean formation 14. The well bore 20 extends through a cased portion 22 and into an un-cased open-hole portion 24. In the cased portion 22 of the well, the well bore 20 is supported by a casing 26. The well bore typically is cased continuously from the well surface but can also be intermittently cased as circumstances require. The well is illustrated for convenience as vertical, but as explained above, it is anticipated that the invention may be utilized in a horizontal well.

The tubing string 10 can carry packers, circulating and multi-position valves, cross-over assemblies, centralizers, various tool assemblies and the like to control the flow of fluids through the tubing string, the placement of the string in the well bore 20 and other operations.

The tubing string 10 includes a tubing assembly 50. The tubing assembly 50 has an outer surface 52 which creates an annular space 54 between the outer surface 52 and the wellbore 20. The tubing assembly 10 can be radially expandable and can include various assemblies as are known in the art, including cross-over assemblies, valves, mandrels, various flow passages and means for regulating flow, etc.

The tubing assembly 50 can include a sand-control assembly 60. The sand-control assembly 60 can include one or more slotted liners, sand screens, screen shrouds, etc. as are known in the art. The sand control device 60 can be a slotted or perforated liner or sleeve, such as are known in the art. In the case of a slotted or perforated liner it may be desirable to plug the holes in the liner during run-in of the tools and completion of the packing procedure. The holes can later be unplugged, or the plugs be removed, to allow fluid flow into the tubing string. Alternately, the sand-control device can be a section of tubing to be perforated to allow fluid flow into the tubing, as is known in the art. The assembly can include sand screen assemblies. For example, the sand-control assembly can include one or more sand screen known as Poroplus Sand Control Screens (trademark), available commercially. The sand-control assembly which includes expandable screens that can be radially expandable as is known in the art. Some examples of currently available expandable screens are PoroFlex™ expandable screens (Halliburton Energy Services, Inc., and Expandable Sand Screens (Weatherford International Inc.). The sand-control device can further be retrievable. The sand-control device 60 is placed adjacent the zone 12 to be produced.

Figure 2A:
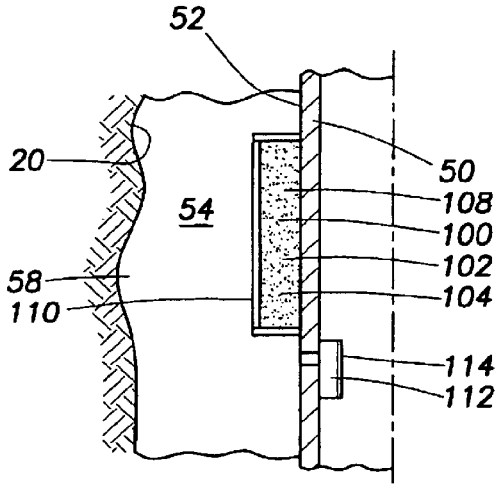
FIGS. 2A and 2B are partial cross-sectional views of one embodiment of the invention.
Figure 3A:
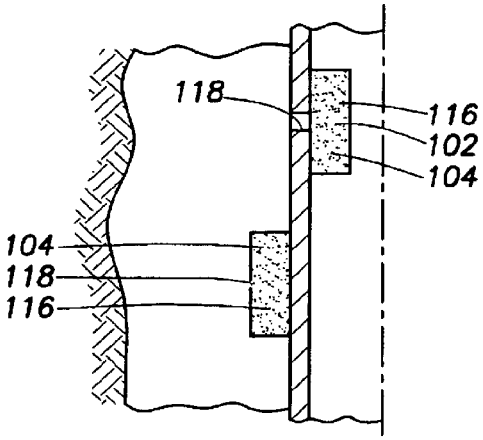
FIGS. 3A and 3B are partial cross-sectional views of another embodiment of the invention.

The tubing assembly 50 has an expandable media assembly 100 attached thereto. The expandable media assembly 100 includes an expandable medium or material 102. The expandable material 102 is maintained in a run-in position 104, as seen in FIGS. 1, 2*a* and 3*a*, during running the tubing assembly and expandable media assembly 100 into the wellbore. In the run-in position 104, the expandable material 102 maintains a low-profile, or does not extend from the tubing assembly outer surface 52, so as not to interfere with the run-in operation and to avoid damage to the assemblies during run-in operations.

Figure 2B:
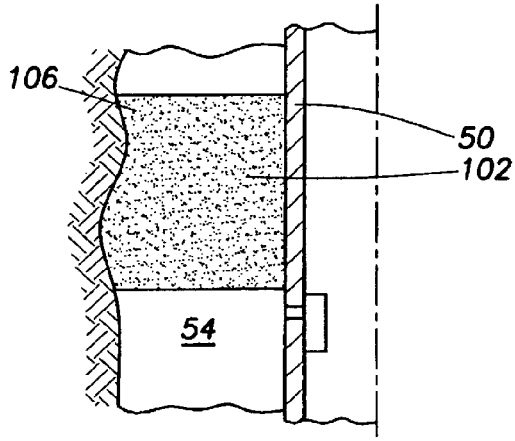
Figure 3B:
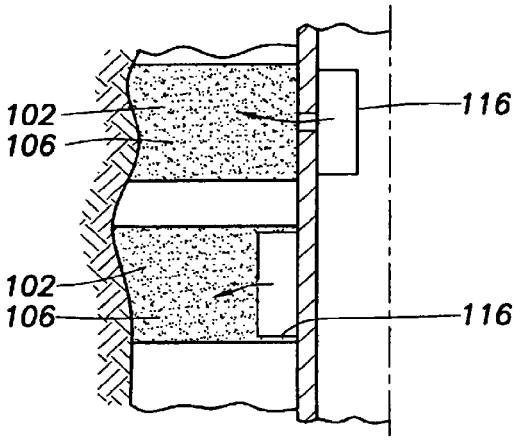

The expandable material 102 is capable of enlarging, swelling or otherwise increasing in volume to a set position 106, as seen in FIGS. 2B and 3B. When the tubing and expandable media assemblies are located at a selected location along the wellbore, the expandable material 102 is enlarged to fill the annular space 54 between the outer surface 52 of the tubing assembly 50 and the wellbore 20. The expandable material can be used along a cased section of the well or in an open-hole portion of the well. The expandable material 102 is impermeable and so prevents fluid flow radially and axially along the annular space. Preferably the expandable material is deformable so as to conform to the shape of the wellbore 20, including filling voids 58 along the wellbore. The expandable material can be an expandable solid, such as a foam or alloy, an expandable gel, foam or resin, or a compressed releasable material such as a spray which hardens into a barrier.

The expandable media assembly 100 and material 102 can take many forms and not vary from the spirit of the invention. In one embodiment, seen in FIGS. 2A and 2B, the expandable media assembly 100 includes an expandable material 102 that is formed into a sleeve or wrap 108. The sleeve 108 can be slid over the tubing assembly or formed thereon by wrapping or otherwise applying the material 102 to the exterior of the tubing assembly. The sleeve can be attached to the tubing assembly by a pressure fit, glue, mechanical or other means. The sleeve 108 can be formed of a foam or other material which can increase in volume when activated or which can be compressed into the run-in position.

Preferably the sleeve is formed of a foam material. Such foam materials are commercially available from Foamex International, Inc., and include such products as Custom Felt 4-900C, 6-900C, 8-900C, 10-900C or 12-900C, Isoseal™ Low Perm 180 or 280, Super Seal W or Spectroseal™ Other products may be used or developed, but they must be capable of withstanding the rigors of the downhole environment and maintaining an annular barrier. The material can be porous, like foam, but not permeable. Products can be selected which meet requirements such as chemical resistance, temperature handling capability, resilience or firmness, as desired.

The foam or other material can be compressed into the run-in position and maintained in that position with a restraint 110. For example, the foam can be pressure-packed, vacuum-packed, or otherwise shrunk, to its run-in size and then wrapped with a restraint such as shrink-wrap, heat-wrap, or encasing film or straps. The restraint 110 holds the expandable material 102 in its run-in position until it is desired to enlarge the material. The restraint 110 can be released mechanically, such as by cutting, chemically, such as by dissolving the restraint, by using a heat, time or stress activated material or by other means known in the art.

The expandable material 102 may be increased in volume to its set-position 106 by various methods. The material 102 may be pre-shrunk prior to insertion into the wellbore, as described above, and then released to return to its enlarged size. Alternately, if the material 102 is available in an unexpanded state, it can be formed, applied or placed onto the tubing assembly in its run-in position without any restraints and later expanded downhole. Such a material could be expanded upon activation by well temperature, time, stress, or induced by introduction of or exposure to an activation agent after positioning in the well. If the material is activated by introduction or exposure to a substance downhole, the restraint 110 may also act as an isolation barrier until activation is desired. If the expandable material enlarges upon exposure to an activation agent 112, the agent 112 can be carried on the expansion assembly in an appropriate container 114 or pumped downhole after placement of the expansion assembly.

In another embodiment, seen in FIG. 3B, the expandable material 102 is carried downhole in an appropriate pressurized container 116. Upon placement of the expandable media assembly, the material 102 is released from the container 116 through one or more outlets 118 in the container. The expandable material, preferably a foam or gel, evacuates the container through the outlets and fills the annular space between the wellbore and the tubing assembly. The expandable material, upon filling the annular space, sets or hardens to provide a stable annular barrier, as seen in FIG. 3B. As seen, the container can be placed on the exterior or interior of the tubing assembly.

In use, the tubing assembly and expandable media assembly are deployed downhole and the expandable material is enlarged thereby creating an impermeable annular barrier. Multiple expandable media assemblies can be placed along a wellbore to effectively isolate one or more subterranean zones, as seen in FIG. 1. The expandable media assemblies are employed above and/or below the zones 12 of interest and employed to produce annular barriers as described.

Figure 4A:
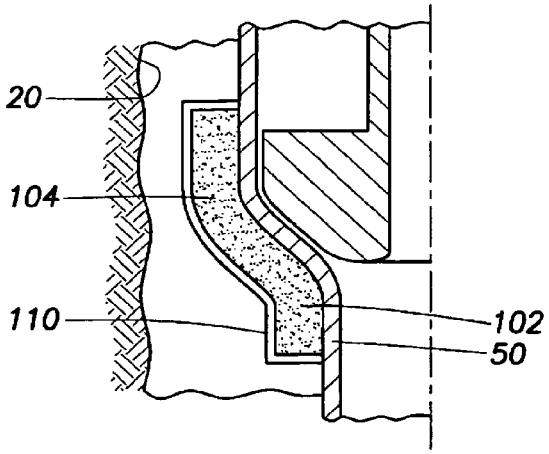
FIGS. 4A and 4B are partial cross-sectional views of another embodiment of the invention.
Figure 4B:
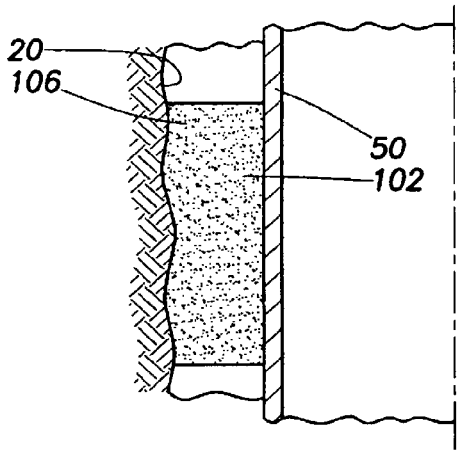
Figure 5A:
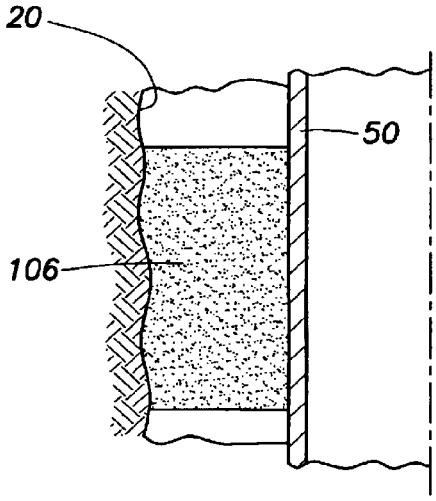
FIGS. 5A and 5B are partial cross-sectional views of another embodiment of the invention.
Figure 5B:
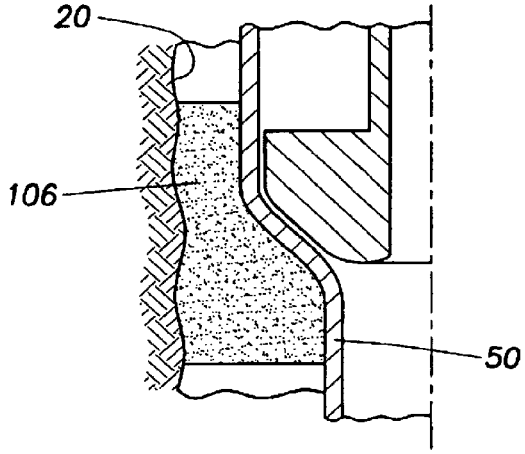

It is also possible to use the expandable assembly in conjunction with a mechanically, radially expandable tubing assembly. The tubing assembly is radially expandable using an expansion cone 120 or other mechanical instrument as is known in the art. The tubing assembly is radially expanded as shown in FIG. 4A and the expandable material enlarged as in FIG. 4B. It is preferred that the tubing assembly be radially expanded before release or enlargement of the expandable material 102, however, the expandable material 102 can be enlarged and then the tubing assembly mechanically radially expanded, as shown in FIGS. 5A and 5B. The expansion cone, or other expansion device, such as is known in the art, can be hydraulically actuated by a downhole force generator or can be forced along the tubing string by weight applied to the work string. The expansion of the expandable tubing assembly can occur from top-down or from bottom-up, as desired. Similarly, the sand-control device or screen assembly 60 can be radially expandable and can be expanded before or after enlargement of the expandable material.

Preferably the annular barrier of expandable material 102 is removable. The material 102 can be drilled or milled out. Alternately, the barrier can be sufficiently damaged by exposing to a reagent, such as an acid wash, to compromise the stability of the barrier.

It will be seen therefore, that the apparatus and method addressed herein are well-adapted for use in preventing annular fluid flow along a wellbore annulus. After careful consideration of the specific and exemplary embodiments of the present invention described herein, a person of skill in the art will appreciate that certain modifications, substitutions and other changes may be made without substantially deviating from the principles of the present invention. The detailed description is illustrative, the spirit and scope of the invention being limited only by the appended claims.

What is claimed is:

1. An apparatus for use in a subterranean well having a wellbore, the apparatus comprising:

a tubing assembly for placement in the wellbore, the tubing assembly having an outer surface, the tubing assembly creating an annular space between the outer surface and the wellbore when the tubing assembly is placed in the wellbore; and a sleeve comprising an expandable material carried on the outer surface of the tubing assembly, the expandable material in a run-in position and capable of increasing the volume to a set position in contact with the wellbore thereby creating an annular barrier blocking fluid flow along the annular space;

wherein the expandable material is a foam.

2. An apparatus as in claim 1 further comprising a restraint for maintaining the expandable material in the run-in position.

3. An apparatus as in claim 2 wherein the restraint is a film.

4. An apparatus for use in a subterranean well having a wellbore, the apparatus comprising:

a tubing assembly for placement in the wellbore, the tubing assembly having an outer surface, the tubing assembly creating an annular space between the outer surface and the wellbore when the tubing assembly is placed in the wellbore; and a sleeve comprising an expandable material carried on the outer surface of the tubing assembly, the expandable material in a run-in position and capable of increasing in volume to a set position in contact with the wellbore thereby creating an annular barrier blocking fluid flow along the annular space;

wherein the expandable is an alloy.

5. An apparatus as in claim 4 wherein the sleeve is pressure fit on the tubing assembly.

6. An apparatus as is claim 4 wherein the sleeve is glued to the tubing assembly.

7. An apparatus as in claim 4 wherein the sleeve is formed of a sheet of material.

8. An apparatus for use in a subterranean well having a wellbore, the apparatus comprising:

a tubing assembly for placement in the wellbore, the tubing assembly having an outer surface, the tubing assembly creating an annular space between the outer surface and the wellbore when the tubing assembly is placed in the wellbore; and a sleeve comprising an expandable material carried on the outer surface of the tubing assembly, the expandable material in a run-in position and capable of increasing in volume to a set position in contact with the wellbore thereby creating an annular barrier blocking fluid flow along the annular space;

wherein the expandable material sets into a substantially non-deformable solid.

9. A method of completing a subterranean well having a wellbore, comprising:

attaching a sleeve comprising expandable material to an outer surface of a tubing assembly, placing the tubing assembly in the wellbore, the tubing assembly creating an annular space between the outer surface of the tubing assembly are the wellbore; and increasing the volume of the expandable material causing the expandable material to contact the borehole and creating an impermeable annular barrier in the annular space;

wherein the expandable material is a foam.

10. A method as in claim 9 further comprising using a restraint for maintaining the expandable material in a run-in position, and releasing the restraint.

11. A method of completing a subterranean well having a wellbore, comprising:

attaching a sleeve comprising expandable material to an outer surface of a tubing assembly, placing the tubing assembly in the wellbore, the tubing assembly creating an annular space between the outer surface of the tubing assembly are the wellbore; and increasing the volume of the expandable material causing the expandable material to contact the borehole and creating an impermeable annular barrier in the annular space;

wherein the expandable material is an alloy.

12. A method of completing a subterranean well having a wellbore, comprising:

attaching a sleeve comprising expandable material to an outer surface of a tubing assembly, placing the tubing assembly in the wellbore, the tubing assembly creating an annular space between the outer surface of the tubing assembly are the wellbore;

increasing the volume of the expandable material causing the expandable material to contact the borehole and creating an impermeable annular barrier in the annular space; and allowing the expandable material to set into a hardened material.

13. An apparatus for use in a subterranean well having a wellbore, the apparatus comprising:

a tubing assembly for placement in the wellbore, the tubing assembly having an outer surface, the tubing assembly creating an annular space between the outer surface and the wellbore when the tubing assembly is placed in the wellbore;

an expandable media assembly having an expandable material, the expandable material in a run-in position and capable of increasing in volume to a set position in the wellbore thereby creating an annular barrier blocking fluid flow along the annular space; and a shrink wrap restraint maintaining the expandable material in the run-in position.

14. A method of completing a subterranean well having a wellbore, the method comprising the steps of:

placing a tubing assembly in the wellbore, the tubing assembly having outer surface, thereby creating an annular space between the outer surface of the tubing assembly and the wellbore;

placing an expandable media assembly in the wellbore, the expandable media assembly comprising an expandable material and a shrink wrap restraint for maintaining the expandable material in a run-in position;

releasing the restraint; and increasing the volume of the expandable material and creating an impermeable annular barrier in the annular space.

15. A method of completing a subterranean well having a wellbore, the method comprising the steps of:

placing a tubing assembly in the wellbore, the tubing assembly having an outer surface, thereby creating an annular space between the outer surface of the tubing assembly and the wellbore;

placing an expandable media assembly in the wellbore, the expandable media assembly comprising an expandable material and a restraint for maintaining the expandable material in a run-in position;

exposing the restraint to heat, thereby releasing the restraint; and increasing the volume of the expandable material and creating an impermeable annular barrier in the annular space.

* * * * *